United States Patent [19]

Kamel

[11] 4,391,021

[45] Jul. 5, 1983

[54] APRON DRAFTING SYSTEM

[75] Inventor: Fouad A. Kamel, Pineville, N.C.

[73] Assignee: Whitin Roberts Company, Charlotte, N.C.

[21] Appl. No.: 313,318

[22] Filed: Oct. 19, 1981

[51] Int. Cl.[3] ..... D01H 5/86

[52] U.S. Cl. ..... 19/253; 19/254; 19/295

[58] Field of Search ..... 19/244, 252, 253, 254, 19/255, 294, 295

[56] References Cited

U.S. PATENT DOCUMENTS

| | | | |
|---|---|---|---|
| 2,717,425 | 9/1955 | Noquera | 19/255 |
| 2,905,977 | 9/1959 | Snyder | 19/253 |
| 2,944,300 | 7/1960 | Swanson | 19/254 |
| 3,031,724 | 5/1962 | Butler | 19/252 X |
| 3,254,375 | 6/1966 | Wartheu | 19/255 |
| 3,561,064 | 2/1971 | Kemmler | 19/255 |
| 3,600,759 | 8/1971 | Grishin | 19/255 |
| 4,067,088 | 1/1978 | Würmli | 19/253 |

*Primary Examiner*—Louis Rimrodt

*Attorney, Agent, or Firm*—Bell, Seltzer, Park & Gibson

[57] ABSTRACT

An apron drafting system for textile fibers includes a pair of front rolls, a pair of middle rolls, and a pair of back rolls defining front and back drafting zones therebetween. A cradle, including a pair of side plates, is mounted on both of said middle rolls and extends towards both said front rolls and said back rolls to support a pair of front apron pins adjacent the front rolls and a pair of back aprons pins adjacent the back rolls. Top and bottom aprons extend over the middle rolls and over the apron pins adjacent both the front and back rolls to make adjacent contact to guide the textile fibers from a point immediately adjacent the back rolls, through the nip between the middle rolls, to a point adjacent the front rolls. The cradle also includes a pair of platform members, one in the front drafting zone and another in the back drafting zone, which serve to deflect the top and bottom aprons where they are in abutting contact out of the normal path between the rolls to provide improved control over the textile fibers while in the drafting zones.

23 Claims, 9 Drawing Figures

FIG. 1
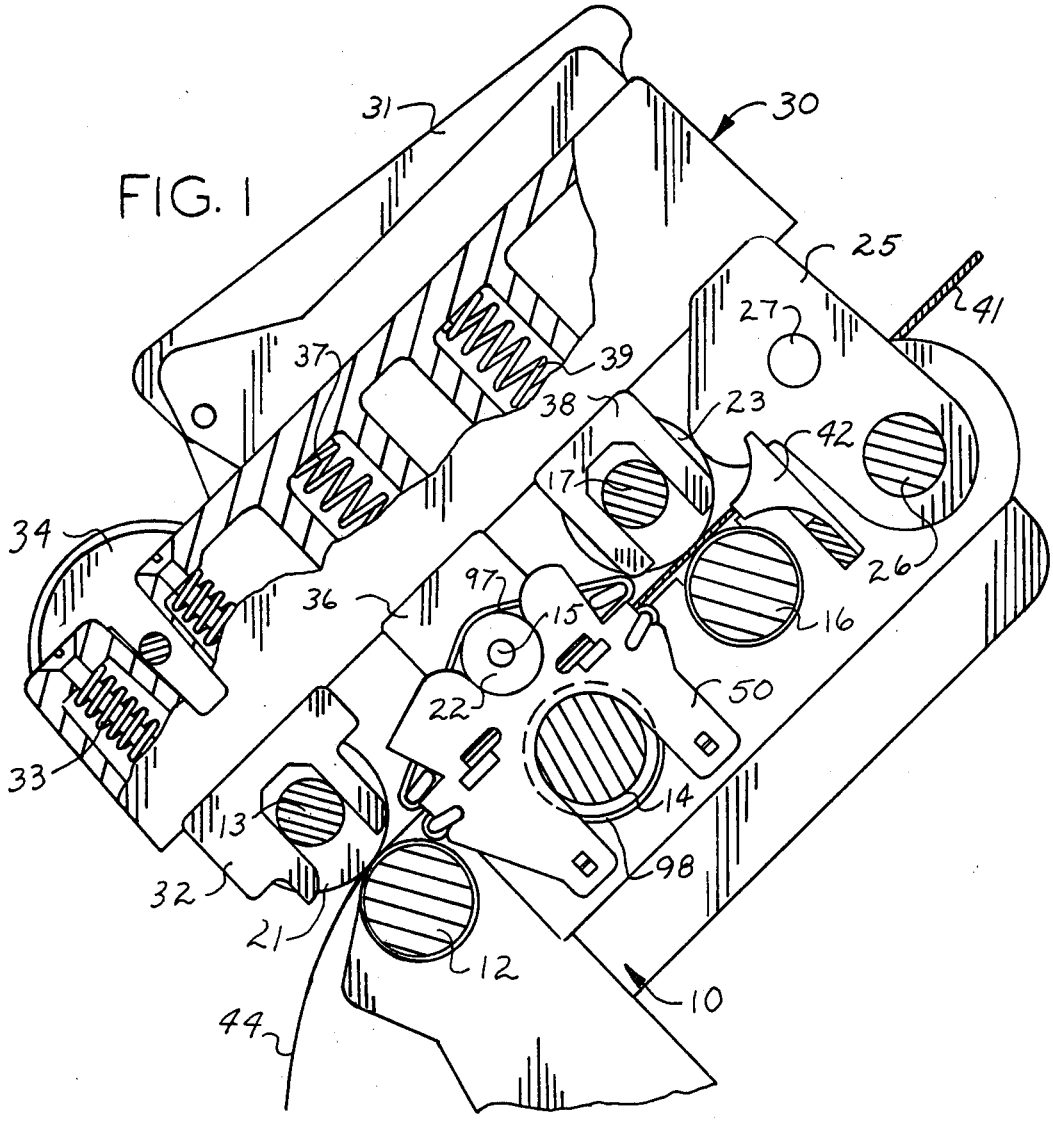
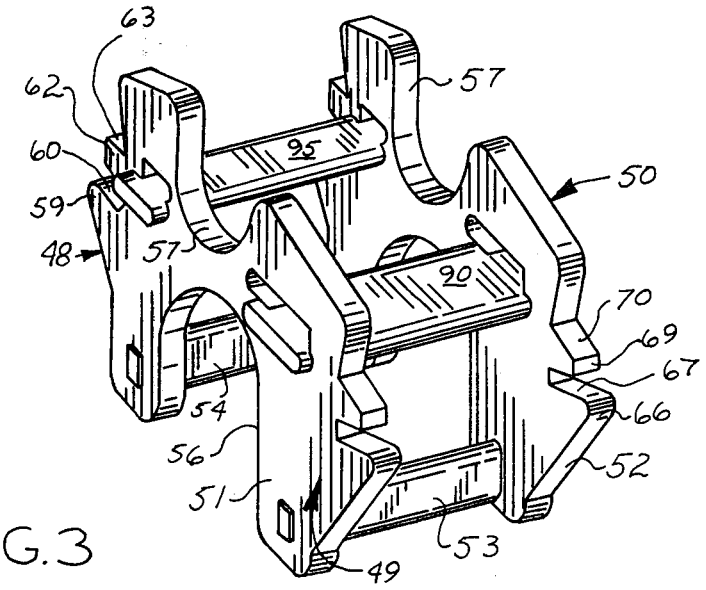
FIG. 3

APRON DRAFTING SYSTEM

BACKGROUND OF THE INVENTION

The present invention relates generally to apron drafting systems for textile fibers, and more particularly to an apron arrangement for use in a three or more roll system of the type used in spinning and roving frames.

Most spinning frames, as well as roving frames, today use what is known as a "three-roll system" in which there are three pairs or sets of upper and lower rolls at spaced intervals, the textile fibers being fed initially to the back rolls from which they pass to the middle rolls and then to the front rolls from which the drafted fibers pass through a twisting arrangement to a spindle-mounted bobbin on which the finished yarn or roving is wound. In each of the pairs of rolls, the bottom roll is driven at a predetermined speed, with the back bottom roll rotating at the lowest speed and the intermediate bottom roll being driven at a slightly higher speed. The front bottom roll is driven at a still higher speed, and the ratio of the speeds constitutes the draft ratio. That is, the speed ratio between the middle bottom roll and the back bottom roll defines the break or back draft ratio, and the speed ratio between the front bottom roll and the middle bottom roll is the final or front draft ratio. Generally, the back draft ratio is relatively small and, conventionally, is between 1.2:1. and 1.5:1. The front draft ratio is much higher, and may range between 15:1 and 30:1. Since the total draft ratio is the product of the two ratios, the total draft ratio is therefore generally between 18:1 and 45:1 for spinning frames. While the higher ratios are desired to provide flexibility to spin yarn counts from coarser roving, such higher ratios tend to produce yarns of lower quality because they introduce unevenness in the cross-sectional density of the yarn. The magnitude of unevenness is related to the amount of draft.

The top rolls are freely rotatable, being driven by the adjacent bottom roll, and a top arm arrangement is used to support and position the top rolls and apply a spring-biasing or weighting force on the top rolls to provide the proper weighting or compressive force between the respective top and bottom rolls. Furthermore, the spacing between the sets of rolls is generally adjustable, and can be varied depending upon the staple length of the particular textile fibers.

In order to provide control for the fibers in the front drafting zone, to provide better evenness of the fibers in view of the high draft ratios in this zone, an apron guiding system is provided utilizing flat rubber aprons extending both above and below the path of the fibers. Conventionally, the bottom apron passes around the bottom middle roll forwardly toward the front bottom roll, where it passes over a guide or apron pin and returns to the middle bottom roll directly below the fiber path. Likewise, the top apron extends around the top intermediate roll forwardly in close abutting proximity with the bottom apron roll around an upper deflecting or apron pin and back above the fiber path to the top middle roll. Generally, the guide pins or apron pins are arranged as close as possible to the nip between the front rolls, so that in this front drafting zone the fibers can be guided between the two aprons for the maximum possible distance in the drafting zone. The structures for the mounting of the aprons fall generally into two types. One of these is the so-called "split cradle" design, in which the structures for mounting and guiding the two aprons are separate, and when the top arm is raised to raise the top rolls, the top apron and its mounting assembly move with it to open up and expose the complete fiber path between the back and front rolls. The other type is the one-piece cradle, in which the top and bottom aprons and the guide pins are mounted on a single cradle member which is positioned by both the top and bottom middle rolls in such a way as to be securely held in place when the top arm is in the clamped position.

Although the above-described apron arrangement has received wide usage, various other apron arrangements have been proposed, including extending the same aprons into the back drafting zone around suitable deflecting elements in these zones.

One such arrangement is shown in German patent No. 938,898 utilizing only a bottom apron without a top apron, or with top and bottom aprons, and utilizing rollers in the back drafting zone adjacent the back rolls so that each of the aprons extends in abutting contact with the other apron from a pair of rollers in the back zone close to the back rolls through the nip between the middle rolls to a conventional apron guide pin adjacent the front drafting rolls.

Another arrangement similar to that of the above patent has been shown in U.S. Pat. No. 4,067,088, which shows a split cradle arrangement having apron guide bars for both the top and bottom aprons in both the front and back draft zones, and showing an arrangement in which the aprons extend a greater distance in the back draft zone than in the front zone.

SUMMARY OF THE INVENTION

The present invention provides an improved double-apron, three or more roll type drafting system which provides superior yarn quality and increased rate of production by providing better fiber control in the back or brake draft section and by allowing the use of substantially higher back draft ratios to increase the overall draft ratio of the system between the back and front rolls.

The system uses the conventional set of three rolls consisting of top and bottom back rolls, top and bottom middle rolls, and top and bottom front rolls. The bottom roll of each set is driven at differential speeds, so that the bottom middle roll rotates faster than the back middle roll, and in turn the bottom front roll rotates faster than the bottom middle roll, to define the draft ratios in each section between the respective rolls. In conventional manner, the top rolls are all weighted to ride against the respective bottom rolls in a conventional top arm construction, and a one-piece cradle assembly is used to support the top and bottom aprons. The cradle includes a pair of side plates notched both to fit over the bottom middle roll and to receive the top middle roll. These side plates support sets of apron pins adjacent both the front rolls and the back rolls so that the top and bottom aprons extend through the nip between the middle rolls toward both the nip of the front rolls and the nip of the back rolls in parallel, abutting relationship, the aprons thus providing a supportive and guiding function not only for the fibers in the front drafting zone in the conventional manner, but also for the fibers in the back drafting zone.

To improve fiber control in the two drafting zones, the cradles can be fitted with platform members which deflect the aprons in both the front and back drafting zones out of a straight-line path to provide improved fiber control by the resulting curved apron path. Various arrangements of platforms may be used to vary the amount of deflection from that which would occur if the platforms were not present. The platforms may be arranged so that both of the deflections are in the same direction, or they may be in opposite directions to provide an S-shaped path. Furthermore, by providing full apron control over the fibers in both of the drafting zones, the roll spacing, as a function of staple fiber length, is not as critical, and the spacing of the back and middle rolls can be increased.

Another feature of the cradle arrangement is that the length of the apron extension on each side of the middle rolls can be different. Thus, if it is desired to change staple length, the cradle can simply be reversed, so that the longer extent is in either the front drafting zone or in the back drafting zone, and different staple lengths can be accommodated solely by changing the location of the set of middle rolls without corresponding change in position of the back drafting rolls.

BRIEF DESCRIPTION OF THE DRAWINGS

FIG. 1 is a cross-sectional view, with parts broken away, of a three-roll drafting system for a spinning frame incorporating the present invention;

FIG. 3 is a perspective view of the cradle without the aprons in place;

DESCRIPTION OF THE PREFERRED EMBODIMENT

Figure 2:
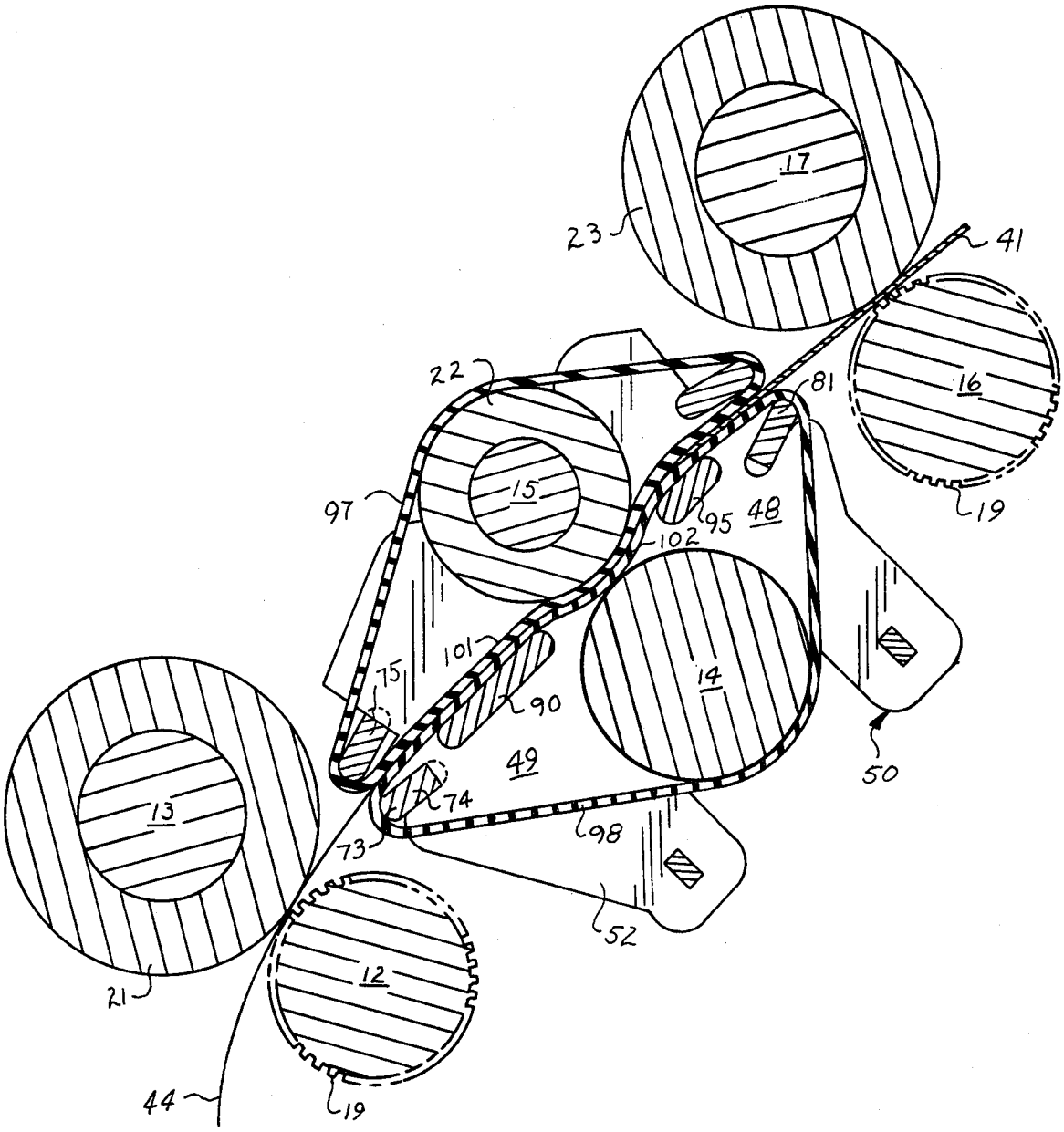
FIG. 2 is an enlarged, cross-sectional view through the cradle shown in FIG. 1, showing details of the fiber path.

Referring to the drawings in greater detail, FIG. 1 shows a three-roll drafting system of the type used on spinning frames for producing yarn from roving of cotton or blends of cotton with synthetic fibers. The unit is supported on a roll stand 10 on which are mounted bearings (not shown) for supporting a front bottom roll 12, a middle bottom roll 14, and a back bottom roll 16 in the conventional manner. It will be understood that in a conventional spinning frame there will be a large number of roll stands and drafting units placed side by side along the frame, and the three bottom rolls extend the entire length of the frame from a head end unit where they are rotatably driven. In the conventional manner, the position of the front bottom roll 12 is fixed and is driven at a rotational speed determined by the desired feeding rate of the drafted yarn to the twisting and take-up mechanism below the drafting unit. The spacing between the front bottom roll 12 and the middle bottom roll 14, as well as the spacing between the middle bottom roll 14 and the back bottom roll 16, can be varied as required for different fiber staple lengths, and the middle bottom roll 14 is driven by a change gearing arrangement from the front bottom roll 12. The relative speeds between the front and middle bottom rolls determine the front draft ratio, and this ratio generally varies between 15:1 and 30:1, with the middle bottom roll being rotated that much slower than the front bottom roll. Likewise, the back bottom roll 16 is driven from the middle bottom roll 14 by another change gear arrangement, the ratio of which determines the back or break draft ratio, which is usually much lower than the front draft ratio, being in the range of 1.2:1 to 1.5:1. The product of the front draft ratio and the back draft ratio is the overall draft ratio representing the total draft of the fibers from the incoming roving to the finished yarn as it passes the front roll position.

Each of the bottom rolls has an associated top roll which is mounted in the top arm, as described in greater detail hereinafter. Thus, there is a front top roll 13 positioned above the front bottom roll 12 and a middle top roll 15 positioned above the middle bottom roll 14, as well as a back top roll 17 positioned above the back bottom roll 16. Each of the top rolls is arranged to be freely rotatable and driven by frictional contact with the associated bottom roll. The top rolls are generally short and extend on either side of the top arm so as to extend over to adjacent drafting stations. Normally, the front bottom roll 12 and the back bottom roll 16 are provided with longitudinally extending flutes 19 on the outer surface to provide proper gripping contact with the fibers. Likewise, the front top roll 13 generally has a rotatable resilient rubber cot 21 on its outer surface to make contact with the fibers in the bottom front roll 12 and the back top roll 17 likewise has a cot 23 which functions in a similar manner. While conventionally the middle top roll may be made with a knurled metal surface for frictional engagement with the apron, in the present case it is preferred to provide the middle top roll 15 with a similar rubber cot 22, particularly when brake ratios exceed 2.1 to 1.

At the rearward or upward end of the drafting unit there is located a pivot bracket 25 mounted on a backbar 26 to carry a pivot pin 27. The top arm, indicated generally at 30, is pivotally mounted on pivot pin 27 so that it may be released and raised to lift the front and back top rolls free of the fiber path and to release the middle top roll which remains confined by its apron in the cradle, as explained in greater detail hereinafter. The top arm 30 extends generally parallel to the rolls, and is releasably held in position by a clamp arm 31 acting through a clamping mechanism of conventional construction. The top arm 30 carries a front top roll retainer 32 which is operated through biasing spring 33 to provide the weighting or spring-biasing on the front top roll 13. A suitable clearing roll 34 may also be mounted there to remove fibers from the cot 21 on the front top roll. Likewise, the top arm 30 carries a middle top roll retainer 36 and biasing spring 37 to position the middle top roll and bias it against the middle bottom roll and a back top roll retainer 38 and biasing spring 39 functions similarly with the back top roll 17. As shown in FIG. 1, the roving indicated at 41 enters the drafting unit adjacent the backbar 16, where it passes through an optional condensing trumpet 42 to enter the nip between the top and bottom back rolls 16 and 17. The finished yarn 44 then passes outwardly and downwardly from the nip between the front, bottom, and top rolls 12 and 13 to the twisting and winding portions of the spinning frame. It will be understood that all of the above-described construction is conventional with spinning frames, and has been described for reasons of background only, since it otherwise provides no portion of the novelty of the present invention.

The fiber path between the back and front rolls is most clearly understood with the cradle and apron arrangement shown in greater detail in FIG. 2, together with details of the cradle as shown in FIG. 3. The cradle 50 provides the entire support and guiding structure for the aprons, and is mounted on the top and bottom middle rolls 15 and 14 in a manner not unlike other apron cradles. The cradle 50 includes a pair of side plates 51 and 52, which may be formed of a suitable material such as plastic, and which are secured to each other in a spaced-apart, parallel relationship by means of front and rear spacer bars 53 and 54. Each of the side plates has a slot 56 in the bottom thereof to fit over the middle bottom roll 14 and likewise the plates have an upper slot 57 adapted to receive the middle top roll 15, and it will be understood that by the contact of the slots 56 and 57 with the top and bottom rolls, the cradle 50 is held in place on the drafting station.

The two side plates 51 and 52 are arranged so that they extend for different distances on each side of the slots 56 and 57. The shorter side 48, which may also be called the "American side," as the distance on this side closely approximates the distance for an American type cradle, is generally used for rather short staple lengths in the range of $\frac{7}{8}$ inch to $1\frac{1}{4}$ inches, as is usually used with all cotton yarns. The side plates 51 and 52 extend a greater distance on the staple side 49 and the construction on this side of the cradle is substantially that of the staple type using fiber lengths in the range of 1 1/16 inch to 2 inches, as is commonly used with various synthetics and synthetic and cotton blends. A further advantage of this arrangement will be discussed in greater detail hereinafter.

On the American side 48, the side plates 51 and 52 are provided with a ledge 59 above which is located a slot 60 defined on its upper surface by a projection 62 having an upper side 63. Likewise, on the staple side 49, the side plates 51 and 52 also define a ledge 66 and slot 67 above which is located a projection 69 having an upper side 70. The slot and projection configurations are identical on both sides, and are used for mounting the apron pins. As shown in greater detail in FIG. 6, the apron pin 73 mounted on the staple side 49 has parallel lower and upper arms 74 and 75, which are joined together at the one side by a bend 77. Each of the arms 74 and 75 has notches indicated at 78 and 79 to engage the respective side plates 51 and 52 so that when the apron pin is in position, with the lower arm 74 in the slot 67 and the upper arm 75 above the upper side 70 of projection 69, the notches 78 and 79 serve to position the apron pin, which is further held in place by the tension of the aprons, as described in greater detail hereinafter. It will be noted that the American side 48 mounts another apron pin 81, which is preferably identical in construction to the apron pin 73.

It should be pointed out that the apron pins 73 and 81 are quite rigid in construction, with the arms 74 and 75 and the bend 77 being made of relatively heavy metal. It should further be noted that only the lower arm 74 is fixedly positioned by the slot 67, while the upper arm may be positioned a distance above the upper side 70 of projection 69. The purpose of this is to allow the use of apron pins having variable spacing between the arms 74 and 75. In this case, the lower arm 74 always retains the same position, but the upper arm 75, depending upon the spacing between the arms, may be at different distances above the upper side 70 of projection 69.

Figure 5:
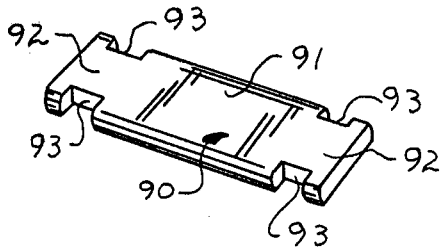
FIG. 5 is a perspective view of one of the platforms used in the cradle.
Figure 4:
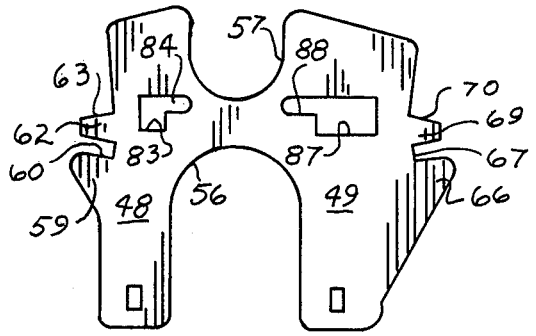
FIG. 4 is a side elevational view of the cradle.
Figure 6:
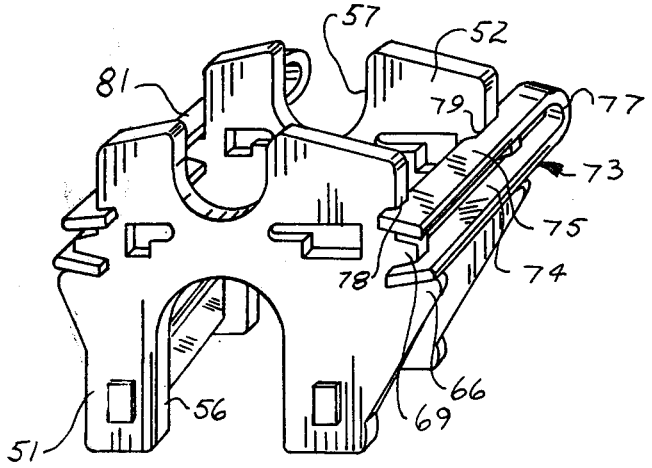
FIG. 6 is another perspective view of the cradle showing the mounting of the apron pins.

As most clearly shown in FIGS. 4 and 6, the side plates 51 and 52 at the American side 48 have a generally square opening 83 therein at the upper side of which is a horizontal extension 84. The openings 83 in the two side plates are aligned, and serve to mount a platform member for deflecting the aprons, as described further hereinafter. Likewise, on the staple side 49 there is a larger rectangular opening 87 with an extension 88 to mount a platform in that section of the cradle as well. As shown in FIG. 5, the platform 90 that is used on the staple side is a flat, rectangular piece of metal having an upper surface 91 and at each end a neck 92 defined by notches 93. When the platform 90 is assembled within the cradle, it is moved laterally through the opening 87, which, together with the extension 88, is wide enough to receive the full width of the platform. When the platform is in position with the neck 92 in alignment with the side plates 51 and 52, the notches 93 then allow the platform to be moved slightly sideways and downward so that the neck 92 fits within the lower portion of the opening 87. At the American side 48, there is provided another platform 95 similar to platform 90 but somewhat narrower in accordance with the dimensions of the opening 83. It will be understood that the width of the platform depends upon the spacing of the adjacent apron pin from the centerline or nip between the top and bottom middle rolls, and that since this spacing is shorter on the American side 48, the platform 95 is narrower than the platform 90.

When the cradle is in place, the lower slots 56 in the side plates 51 and 52 fit over the middle bottom roll 14. Likewise, the middle top roll 15 fits within the slots 57 on the upper side of the side plates 51 and 52, and when the top arm is in the locked-down position as shown in FIG. 1, the middle top roll retainer 36 will hold the middle top roll 15 in position, and thereby hold the cradle 50 in position.

The aprons, which are of conventional construction except for their greater length, are mounted on the cradle 50, with the top apron 97 extending above and below the cot 22 on the middle top roll 15 and around the upper arms of the apron pins 73 and 81. Likewise, the bottom apron 98 extends around the top and the bottom portion of the middle bottom roll 14 and over the lower arms of the apron pins 73 and 81. Thus, the aprons 97 and 98 have confronting portions 101 and 102 that extend in abutting contact from the apron pin 81, over the platform 95, between the middle bottom roll 14 and the middle top roll 15, over the front platform 90 and around the legs 74 and 75 of the apron pin 73. The aprons have a uniform width extending between the side plates 51 and 52 and a uniform thickness, and are made of a suitable rubberlike material. The two aprons may or may not be of identical length, but in any case are of a length so that they are not in tension but have a slight amount of slack in the portions away from the confronting portions 101 and 102. Since the two aprons are tightly gripped between the middle rolls, they are driven by the rolls to have a speed equal to the surface speed of the driving middle bottom roll.

As shown more clearly in FIG. 2, the apron pins 73 and 81 are so positioned that in the absence of the platforms 90 and 95, the path of the fibers and the confronting portions of the aprons 101 and 102 would be deflected slightly toward the bottom middle roll 14 from a straight line path between the openings at the two apron pins. However, the platforms 90 and 95 both deflect the aprons upwardly, or towards the middle top roll 15, to increase the control of the aprons over the fibers. It should be understood that the spacing between the two arms of the apron pins is a variable factor and, by changing apron pins, this spacing can be increased or decreased as desired. Likewise, the platforms 90 and 95 may be removed under some circumstances and may be of different shapes and thicknesses, depending upon the desired path for the aprons. Thus, depending upon the thickness of the platforms, the amount of upward deflections of the aprons can be varied, and while the platforms are shown as having a flat, planar upper surface in contact with the bottom apron 98, these surfaces may be made convex or given other shapes as desired.

In the arrangement shown in FIGS. 1 and 2, the cradle has been shown as having the staple side towards the front rolls so that the aprons extend a greater distance from the middle rolls toward the front rolls than from the middle rolls toward the back rolls. Since the length of the aprons in the front drafting zone is a more critical function of the fiber length of the fibers being drafted, the cradle may be reversed so that the American side 48 extends from the middle rolls toward the front rolls, while the staple side 49 extends from the middle rolls toward the back rolls. If the change in fiber length is not too great, such change can be made without moving the positions of the back rolls, leaving the total space between the front rolls and back rolls unchanged. However, it would then be necessary to move only the middle rolls toward the front rolls so that the apron length in the front draft zone would be shorter, as is necessary with the shorter staple length. In each case, it is still possible to position the apron pins 73 and 81 as close to the nip between the front rolls and the back rolls as desired.

With the drafting system of the present invention, it has been found possible to produce yarns of improved quality while increasing the total overall draft ratio between the back and front rolls. While the changes in the draft ratios may be in both the front and back drafting zones, it has been found that particular advantages are obtained by increasing the back draft ratio to about 2:1 or more, depending upon the particular yarn being drafted and spun. In one test, a mill was spinning a 42/1 combed cotton yarn using a conventional cradle in which the aprons extended only in the front draft zone. They were using a 1.1 Hk roving with a total draft ratio of 40.06. The back draft ratio was 1.54 and the front draft ratio 26.0. The resulting spun yarn had a Uster CV% of 17.75 and the thin places were 126 per 1000 yards, the thick places 265 per 1000 yards, with 93 nips per 1000 yards. Using the arrangement of the present invention on the same spinning frame, and using the same roving to produce the same yarn with the same total draft ratio of 40.06, the ratios were changed so that the back draft ratio was 1.97 and the front draft ratio was reduced to 20.3. In this case, the Uster CV% was 16.1 and the thin, thick, and nips were 58.6, 88.8, and 64.5, respectively. The next experiment utilized the same cradle and apron arrangement of this invention, but the total draft ratio was increased to 56.54 and the roving changed correspondingly to 0.8 Hk. The back draft ratio remained at 1.97, while the front draft ratio was increased to 28.7. In this the yarn had a Uster CV% of 15.61, while the thins, thicks, and nips were 28.8, 69.4, and 54.4 per 1000 yards, respectively. As can be seen from these tests, when the total overall draft ratio was not changed but the ratio was changed using the present invention to increase the back draft ratio and decrease the front draft ratio, very substantial improvements in yarn quality were obtained. Furthermore, if the front draft ratio was increased to increase the total overall draft ratio, even further improvements were noted.

In any case, experiments have shown that with the drafting arrangement of the present invention, it is possible to produce a yarn of improved quality with the same draft ratio as that obtained in the conventional arrangement in which the aprons extend only in the front drafting zone. This is done primarily by increasing the back draft ratio and decreasing the front draft ratio so that the same total overall draft is retained and it is not necessary to change the roving size to produce a given finished yarn size. On the other hand, tests have shown that it is possible to retain a standard, or even slightly increased, front draft ratio with an increased back draft ratio to substantially increase the overall draft ratio so that a heavier roving can be used to produce the same yarn. Furthermore, it has been found that it is possible to increase the spindle speeds with the increased draft ratio to thereby increase the overall productivity of the spinning frame.

Figure 7:
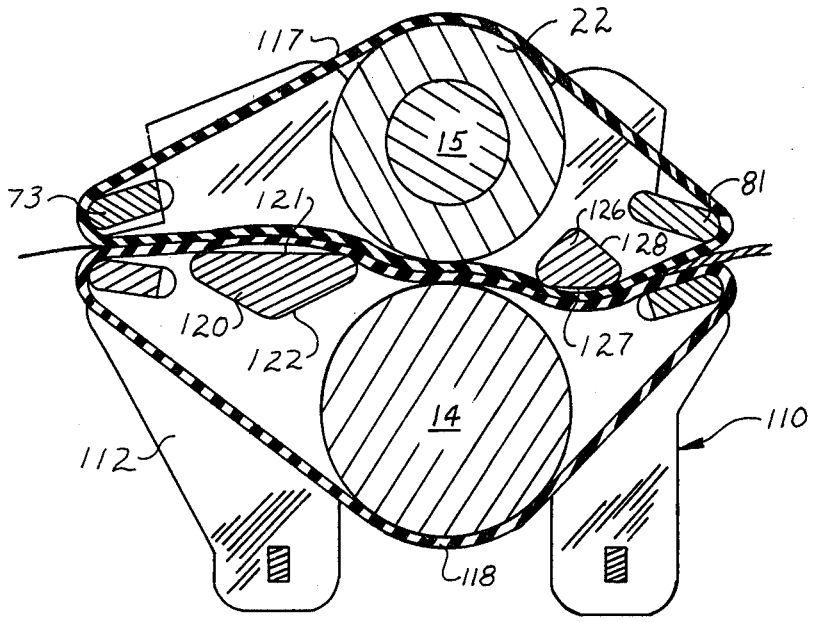
FIG. 7 is a fragmentary, cross-sectional view through a cradle showing another embodiment of the invention.
Figure 8:
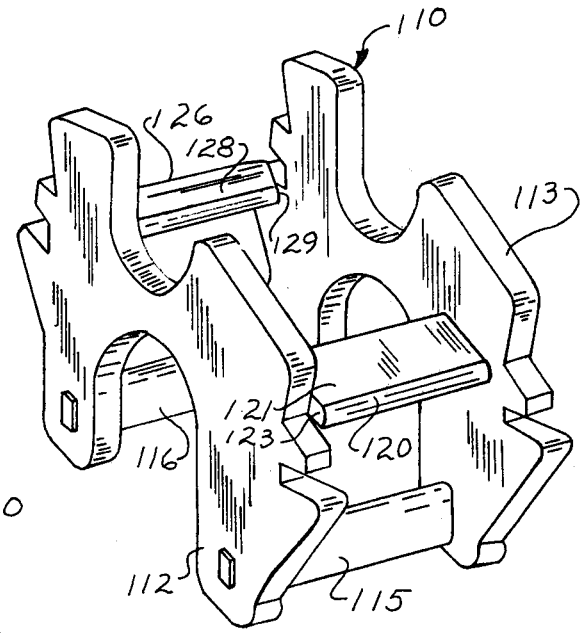
FIG. 8 is a perspective view of the cradle shown in FIG. 7.
Figure 9:
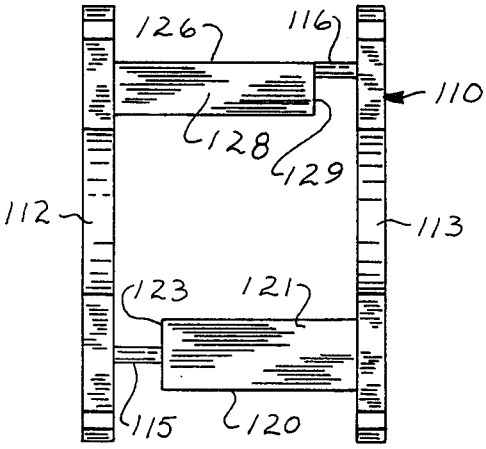
FIG. 9 is a top plan view of the cradle shown in FIG. 8.

Another embodiment of the invention is shown in FIGS. 7–9 employing a different construction for the cradle and the platforms, as well as a different apron path between the apron pins at each end. The cradle 110 comprises a pair of side plates 112 and 113 which are secured together at the bottom by a pair of spacer bars 115 and 116 in the same manner as the cradle 50 of the embodiment of FIGS. 1–6. With the exception of the platforms, the remaining portions of the side plates 112 and 113 are the same as the side plates 51 and 52, and they engage the bottom middle roll 14 and top middle roll 15 in the same manner. Likewise, the side plates 112 and 113 carry the apron pins 81 and 73, and the upper and lower aprons 117 and 118 pass around the apron pins and between the two middle rolls in the same manner as in the embodiment of FIGS. 1–6.

The front platform 120, rather than being a separate piece, is formed integral with the one side plate 113 and when the side plates are made from a molded plastic, the platform is molded integrally with the rest of the side plate. The platform 120 has an upwardly facing apron contacting surface 121, and an underside 122 which may be triangularly shaped to give increased beam strength to the platform because of its cantilever mounting. The platform 120 extends away from the side plate 113 toward the side plate 112 and terminates in an end 123 a spaced distance from side plate 112. Since the platform 120 extends for most of the width of the apron, it provides adequate support, particularly since the fiber path is limited to a small portion of the width of the apron and is generally centered between the two side plates. Actual support of the apron by the platform 120 adjacent the side plate 112 is not necessary.

In like manner, the rear platform 126 is formed integrally with the side plate 112 and extends toward the other side plate 113, where it terminates in an end 29 a spaced distance from side plate 113. However, in the case of platform 126, the apron contacting surface 127 faces downwardly, or in the opposite direction, of the apron contacting surface 121 of front platform 120 and the upper side 128 may be formed with a triangular shape to provide increased beam strength. Because of the gaps between the platforms and the adjacent other side plate, it is easier to assemble the lower apron 118 on the cradle, since it must pass both above and below the platforms. Although the two platforms are shown as being formed integrally with different side plates, it is recognized that both platforms could extend to the same side plate so that both of the gaps at the ends of the platforms are adjacent the same side plate and in line with each other.

As shown in detail in FIG. 7, the platforms of this embodiment deflect the aprons in opposite directions rather than in the same direction, as is the case in the embodiment shown in FIGS. 1-6. The direction of deflection of the aprons is an empirical matter both as to direction and extent of deflection, depending upon the amount of control required for the particular fiber being drafted. In the embodiment of FIG. 7, by having the rear platform deflect the apron downward while the front platform deflects the aprons upwards, the actual path of the fiber between the platforms and through the nip between the rolls 14 and 15 is closer to a straight line and this has been found to be a more desirable arrangement in processing certain fibers than in the arrangement shown in FIGS. 1 through 6, where the deflections are both in the same direction, since, in the first embodiment, there is a greater change of direction in the path at the nip between the two middle rolls.

In addition to the platforms, another variable that can be changed as required is the spacing between the upper and lower apron pins. Since the pins are formed on a single unitary piece joined at the bend, apron pins having different parallel spacing may be used, but the spacing must be varied in the direction of the deflection of the aprons by the platform. Thus, with the embodiment of FIGS. 7-9, the apron pin adjacent platform 120 has the lower leg fixed and the upper leg variable, while in the case of the pin adjacent platform 126, where the aprons are deflected downwardly, it is the upper leg that is fixed and the position of the lower leg that is variable.

While the platforms have been shown as having fixed surfaces with which the aprons make sliding contact, it is possible that in some cases this may result in excessive friction on the aprons. In such case, the effect of the platforms in deflecting the apron path can be accomplished by using freely rotating platform members that make rolling contact with the aprons.

While the preferred embodiment of this invention has been shown and described, it is recognized that additional modifications and rearrangements may be resorted to by those skilled in the art without departing from the scope of the invention as claimed.

What is claimed is:

1. A drafting apparatus for textile fibers comprising a pair of back rolls, a pair of middle rolls, and a pair of front rolls, each of said pairs of rolls including a top roll and a bottom roll, a cradle supported on said middle rolls and including a pair of side plates, a top apron extending around said top middle roll between said side plates, a bottom apron extending around said bottom middle roll between said side plates, said cradle including a pair of front apron pins in the front drafting zone between said front and middle rolls, said cradle including a pair of back apron pins in the back drafting zone between said back and middle rolls, said top apron extending around the top ones of said front and back apron pins, said bottom apron extending around the bottom ones of said front and back apron pins, whereby said top and bottom aprons extend in confronting relationship from said back apron pins through the nip between said middle rolls and to said front apron pins to control the textile fibers in abutting contact in both the back and front drafting zones.

2. A drafting apparatus as set forth in claim 1, wherein said cradle includes a front platform member in said front drafting zone to deflect said top and bottom aprons out of the plane defined by said front apron pins and the nip between said middle rolls.

3. A drafting apparatus as set forth in claim 2, wherein said front platform is carried by said side plates.

4. A drafting apparatus as set forth in claim 3, wherein said front platform member is a separate piece removably mounted on said side plates.

5. A drafting apparatus as set forth in claim 3, wherein said front platform member is formed integrally with one of said side plates as a unitary member and said platform member extends from said one side plate toward said other side plate but is spaced therefrom to define a gap.

6. A drafting apparatus as set forth in claim 1, wherein said cradle includes a front platform in said front drafting zone to deflect said top and bottom aprons out of the plate defined by said front apron pins and the nip between said middle rolls and a back platform in said back drafting zone to deflect said top and bottom aprons out of the plane defined by said back apron pins and the nip between said middle rolls.

7. A drafting apparatus as set forth in claim 6, wherein said front platform and said back platform both deflect the aprons in the same direction with respect to the plane defined by said front apron pins and said back apron pins.

8. A drafting apparatus as set forth in claim 6, wherein said front platform and said back platform deflect the aprons in opposite directions with respect to the plane defined by said front apron pins and said back apron pins whereby the path of said aprons between said back platform and said front platform through the nip between said middle rolls is substantially a straight line.

9. A drafting apparatus for textile fibers comprising a pair of back rolls, a pair of middle rolls, and a pair of front rolls, each of said pairs of rolls including a top roll and a bottom roll, a top apron extending around said top middle roll, a bottom apron extending around said bottom middle roll, a pair of front apron deflecting pins in the front drafting zone between said front and middle rolls, one of said front pins engaging said top apron and the other of said front pins engaging said bottom apron, a pair of back apron deflecting pins in the back drafting zone between said back and middle rolls, one of said back pins engaging said top apron and the other of said back pins engaging said bottom apron, said front and back pair of apron pins holding said aprons in confronting relationship from said back apron pins through the nip between said middle rolls to said front apron pins to control the textile fibers in abutting contact in both the front and back drafting zones, a front platform in said front drafting zone to deflect said top and bottom aprons in abutting contact out of the plane defined by said front and back apron deflecting pins, and a back platform in said back drafting zone to deflect said top and bottom aprons in abutting contact out of the plane defined by said front and back apron deflecting pins.

10. A drafting apparatus as set forth in claim 9, wherein said front and back platforms deflect said aprons in the same direction with respect to said plane.

11. A drafting apparatus as set forth in claim 9, wherein said front and back platforms deflect said aprons in opposite directions with respect to said plane.

12. A cradle assembly for supporting and guiding a pair of aprons in a drafting system which includes a top roll and a bottom roll, said cradle comprising a pair of side plates, means securing said side plates as a unit in spaced, parallel positions, each of said side plates having a recess on the lower side to receive said bottom roll and position said cradle with respect thereto, each of said side plates having a recess on the upper side to receive said top roll and position said cradle with respect thereto, said side plates extending laterally from said recesses on both sides thereof, a first pair of upper and lower apron deflecting pins mounted on said side plates at one side of said recesses, a second pair of upper and lower apron deflecting pins mounted on said side plates on the other side of said recesses, a top apron extending around said upper apron pins, and a bottom apron extending around said lower apron pins, whereby said top and bottom aprons extend in close abutting contact between said first and second pairs of apron pins.

13. A cradle assembly as set forth in claim 12, wherein said side plates extend a greater distance on one side of said recesses than on said other side of said recesses, whereby said first pair of apron pins is spaced farther from said recesses than said second pair of apron pins.

14. A cradle assembly as set forth in claim 12, including a platform member carried by said cradle and extending between said side plates on one side of said recesses and arranged to deflect said top and bottom aprons in abutting contact out of the plane defined by the undeflected path of said aprons between said first and second pairs of apron pins.

15. A cradle assembly as set forth in claim 14, wherein said platform member is a separate piece removably mounted and secured to both of said side plates.

16. A cradle assembly as set forth in claim 14, wherein said platform member is formed integrally with one of said side plates as a unitary member and said platform member extends from said one side plate toward said other side plate but is spaced therefrom to define a gap.

17. A cradle assembly as set forth in claim 14, wherein said cradle assembly includes a second platform on the other side of said recesses arranged to deflect said top and bottom aprons in abutting contact out of said plane.

18. A cradle assembly as set forth in claim 17, wherein said first and second platforms are arranged to deflect said top and bottom aprons in the same direction with respect to said plane.

19. A cradle assembly as set forth in claim 17, wherein said first and second platform members are arranged to deflect said top and bottom aprons in opposite directions with respect to said plane.

20. A cradle assembly as set forth in claim 17, wherein said first and second platform members are separate pieces removably mounted on said side plate in interlocking relationship.

21. A cradle assembly as set forth in claim 17, wherein said first and second platform members are formed integrally with one or the other of said side plates as a unitary, member, and wherein each of said platform members extends from the side plate toward the other side plate but is spaced therefrom to define a gap.

22. A cradle assembly as set forth in claim 21, wherein one of said platform members is formed integrally with one of said side plates and the other platform member is formed integrally with the other of said side plates.

23. A cradle assembly as set forth in claim 21, wherein both of said platform members are formed integrally with the same side plate.

* * * * *